US006282904B1

(12) United States Patent
Kraft et al.

(10) Patent No.: US 6,282,904 B1
(45) Date of Patent: Sep. 4, 2001

(54) FULL RING FUEL DISTRIBUTION SYSTEM FOR A GAS TURBINE COMBUSTOR

(75) Inventors: Robert J. Kraft, Palm City; Vincent C. Martling, West Palm Beach; Brian R. Mack, Palm City; Mark A. Minnich, West Palm Beach; David Stephens, North Palm Beach, all of FL (US)

(73) Assignee: Power Systems Mfg., LLC, Jupiter, FL (US)

( * ) Notice: Subject to any disclaimer, the term of this patent is extended or adjusted under 35 U.S.C. 154(b) by 0 days.

(21) Appl. No.: 09/443,916

(22) Filed: Nov. 19, 1999

(51) Int. Cl.[7] ..... F02C 1/00

(52) U.S. Cl. ..... 60/739; 60/740; 60/746; 60/39.06; 60/39.091; 60/39.11; 60/737

(58) Field of Search ..... 60/739, 740, 746, 60/39.091, 39.11, 39.06, 732, 733, 737

(56) References Cited

U.S. PATENT DOCUMENTS 5,685,139 * 11/1997 Mick et al. ..... 60/39.06
6,038,861 * 3/2000 Amos et al. ..... 60/737

* cited by examiner

*Primary Examiner*—Timothy S. Thorpe
*Assistant Examiner*—E D Hayes
(74) *Attorney, Agent, or Firm*—Malin, Haley & DiMaggio, P.A.

(57) ABSTRACT

A fuel nozzle system for use in a combustor utilized in a combustion turbine for reducing nitrogen oxides and other pollutants including an annular fuel distribution manifold separately mounted away from a diffusion nozzle, said annular manifold having a plurality of fuel emitting passages or holes disposed along the downstream side of the manifold, said manifold being mounted in a position away from the diffuser nozzle body to allow air to stream around the manifold on all sides allowing for a thorough mixture of fuel and air around the annular manifold for better premixing in the combustion chamber.

8 Claims, 10 Drawing Sheets

FULL RING FUEL DISTRIBUTION SYSTEM FOR A GAS TURBINE COMBUSTOR

BACKGROUND OF THE INVENTION

1. Field of the Invention

This invention relates generally to a fuel and air distribution system for use in a gas turbine combustor for reducing the production of nitrogen oxide and other air pollutants and specifically to a premix fuel nozzle for use in the combustion chambers for gas turbine combustors.

2. Description of Related Art

The U.S. Government has enacted requirements for lowering pollution emissions, and in particular, for lowering the amounts of nitrogen oxide (NOx) and carbon monoxide produced by natural gas powered turbines, which in turn generate electricity by being connected to electrical generators. The combustion process of air and natural gas as a fuel in a gas turbine combustion chamber produces pollutants such as nitrogen oxides, which are both NO and NO2, designated generally as NOx. U.S. Government has enacted requirements for lowering pollution emissions, especially for lowering the NOx produced by gas turbines during power generation. Complying with these regulations can be difficult utilizing conventional diffusion burners where the natural gas fuel is introduced directly via a fuel nozzle into the combustion chamber where it is mixed with combustion air. U.S. Pat. No. 4,589,260, issued to Krockow, May 20, 1986, describes a premixing burner with integrated diffusion burner to reduce NOx pollutants in the combustion within a gas turbine combustion chamber. The Krockow invention discloses a burner system for gas turbine combustion chambers which is comprised of using a fuel/air premixing burner with an integrated diffusion burner. The premixing burner has a premixing chamber. The diffusion burner has a main fuel nozzle which is arranged in the central zone of the flame retention baffle. In particular, the premix nozzle includes a series of radial arms disposed into the air flow for premixing the fuel and air prior to its combustion downstream of the diffusion nozzle. One of the problems with such a hybrid system is that the premix nozzles, being on radial arms or pegs, actually do not provide for a uniform distribution of air and fuel mixture and can act as a flame holder. The peg design also produces unmixed areas of fuel and air flow downstream of the pegs.

In response to the requirement of lower pollution with NOx, the industry has adopted a dual-stage, dual-mode, low NOx combustor for use in gas turbine engines. Each of these combustors comprises a primary combustion chamber and a secondary combustion chamber separated by a venturi throat region. The primary combustion chamber includes primary fuel nozzles that deliver fuel into the primary combustion chamber. In a typical system, there are a plurality of primary nozzles arranged in an annular array around a secondary nozzle. For example, each combustor may include six primary fuel nozzles and one secondary fuel nozzle centrally located relative to the six fuel nozzle array. Fuel, which is typically natural gas (but could be any suitable liquid fuel or gaseous fuel), is delivered to each of the primary nozzles by an appropriate fuel pipe. Ignition in the primary combustor takes place by the use of spark plugs within the primary nozzle region.

Surrounded by a plurality of fuel nozzles is an elongated secondary nozzle which is situated somewhat downstream of the primary nozzles. The purpose of the secondary nozzle is to alternately maintain a pilot flame so that the combustion continues in the secondary combustion chamber once the primary chambers' flames have been extinguished. U.S. Pat. No. 4,982,570, issued to Waslo, et al., describes a premix pilot nozzle for dry low NOx combustors that utilizes an integrated, combined, premix nozzle and diffusion nozzle similar to that disclosed in U.S. Pat. No. 4,589,260 to Krockow. The premix nozzle in the '570 Patent is also a plurality of radial fuel distribution tubes which extend radially outward from the axial diffusion nozzle pipe. Each of the radial pipes include a plurality of fuel discharge holes which are directed downstream toward the discharge end of the combined diffusion nozzle. Again, such an integrated system does not provide for complete uniform premixing of air and fuel because of the structural layout of the peg-like fuel distribution arms which are integrated into the diffusion nozzle system. The air gaps get larger radially outwardly from the diffusion nozzle housing. This is especially important when the fuel nozzle system is used in the two-stage, two-mode gas turbine which includes a combustor having a primary combustion chamber and a secondary combustion chamber.

In a typical operational cycle of a two-stage, two-mode gas turbine, fuel is delivered to the primary nozzles with air flow, which is ignited by spark plugs, causing ignition and fire in the primary combustion chambers. This allows for an initial start-up of the turbine to a certain power level. At a desired turbine power level, fuel is then delivered to a secondary nozzle which is ignited from the primary combustion fires causing a pilot flame in the secondary nozzle. Transfer fuel is also provided to the secondary nozzle to increase the secondary nozzle combustion output beyond a pilot flame to allow shutdown of the primary nozzles during combustion transition between the primary combustion chambers and the secondary combustion chambers. Once the secondary pilot flame has been established and transfer fuel is flowing, fuel is shut off to the primary nozzle causing a flame-out in the primary combustion chambers. After flame-out, the fuel supply is again turned on to the primary nozzles and mixed with air. The primary fuel/air mixture flows from the primary combustion chambers into the combustor's secondary combustion chamber past the venturi passage and is continuously ignited by the fire in the secondary combustion chamber. Transfer fuel is shut off in the secondary nozzle. The pilot light in the secondary nozzle is thus used to maintain and insure continuous combustion in the secondary combustion chamber at all times.

The secondary nozzle has also been found to contribute to NOx pollution, especially when functioning as a diffusion nozzle.

Although secondary fuel nozzles that have an integrated premix nozzle and diffusion nozzle pilot light have improved combustion, reducing pollutants, any improvement in further reducing NOx and CO pollutants is important.

The present invention provides for a nozzle system that has a diffusion nozzle for maintaining the pilot light and providing transfer fuel and a separate premix annular full ring fuel distributor separated away from the diffusion nozzle structure and surrounding the diffusion nozzle structure in such a way as to increase the thorough mixing of fuel and air in a premix area resulting in higher efficiency and lower pollutants from the secondary nozzle system. The premix annular ring fuel distributor has a plurality of apertures facing downstream for discharging natural gas (or any suitable fuel), while an air stream flows completely around the surface of the annular ring, greatly enhancing the premixing of the natural gas with the air flowing around the ring.

The separate diffusion nozzle for providing transfer fuel includes a plurality of individual fuel-carrying transfer fuel tubes mounted around a plurality of air-flow channels, all of which terminates at the end of the diffusion nozzle.

SUMMARY OF THE INVENTION

An annular, full-ring fuel distribution device to aid in premixing fuel with an air stream flowing around the annular distribution device utilized in conjunction with a fuel/air delivery system for a gas turbine combustor comprising an annular, rigid hollow body constituting a manifold, said annular manifold body having a plurality of apertures or holes disposed on one side of said annular manifold tube and a sleeve mounting system for mounting said annular manifold in a predetermined location with respect to a separate diffusion nozzle housing for transferring fuel and retaining a pilot light, said annular manifold mounted circumferentially away from and around said separate diffusion nozzle body.

A fuel supply conduit is connected to a fuel source at one end and to said annular manifold at its opposite end allowing fluid fuel communication to fill said annular manifold.

The annular hollow body, forming the manifold which includes apertures on one side, allow for the escape of the fuel such as natural gas. The annular manifold is disposed within a secondary nozzle system chamber and has air under pressure forming a air stream passing all the way around on all sides of the annular manifold body. The exterior cross sectional shape may be formed to aid in the mixing process. The holes in the annular manifold body may be arranged such that the axis of each hole is angular with respect to the manifold downstream sidewall to allow the discharge of gas in different angular directions in light of having holes whose axially flow directions, based on their central axes, are different and inclined relative to the air flow stream.

The secondary nozzle system also includes an elongated diffusion nozzle body that includes a plurality of fuel transfer tubes circumferentially disposed about a secondary inner housing having a plurality of air passages, all of which terminate at a swirl spool at the diffusion pilot light end of the diffusion nozzle. At the end of the diffusion nozzle system is a diffuser which allows for air and fuel to be defused for enhancing the pilot light burn.

During operation of a secondary fuel nozzle system, especially in a two-stage combustor, fuel is supplied to the annular manifold which allows for efficient mixing of air and fuel all the way around the diffusion nozzle elongated body. The fuel/air mixture traverses past the end of the diffusion nozzle where it is ignited by the diffusion flame, enhancing the quality and integrity of the secondary flame into the secondary combustion chamber. Since the bulk of a fuel is premixed efficiently without non-homogenous areas, the amount of pollutants of NOx is reduced.

It is an object of this invention to provide an improved combustor for a gas turbine engine that reduces NOx pollutants during operation.

It is another object of this invention to provide an improved secondary fuel nozzle system for a two-stage, two-mode combustion turbine engine that has a separate premix annular distribution system for improving efficiency and ease of manufacturing using standard stock.

In accordance with these and other objects which will become apparent hereinafter, the instant invention will now be described with particular reference to the accompanying drawings.

PREFERRED EMBODIMENT OF THE INVENTION

Figure 1:
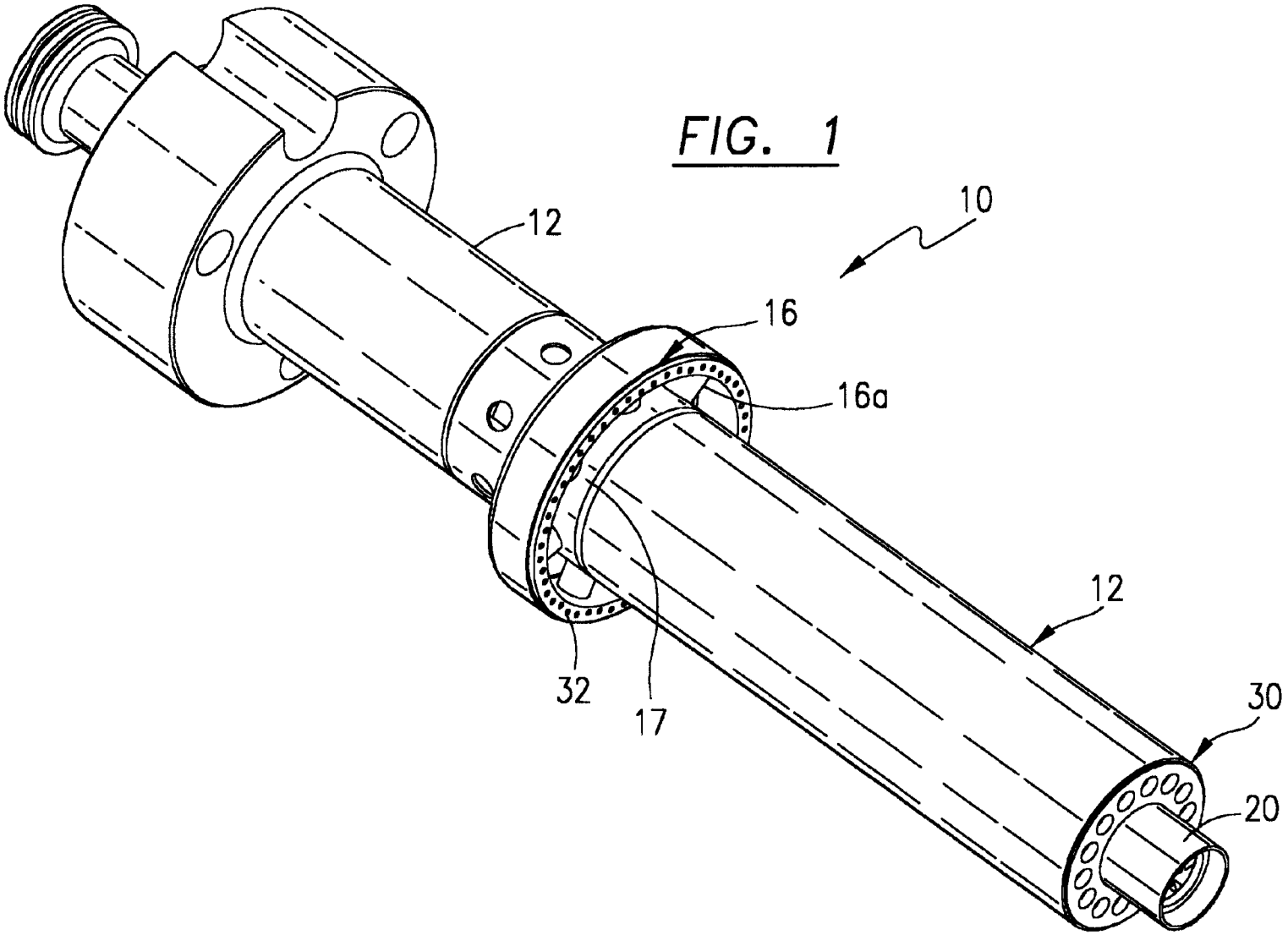
FIG. 1 is a perspective view of the present invention.

Referring now to the drawings, and in particular FIG. 1, the present invention is shown generally at 10 comprising an annular fuel distribution manifold 16 that is mounted by support sleeve 17 and support cylinders 16*a* to a diffusion nozzle housing 12 that terminates at one end with a diffusion nozzle 20 that provides the diffusion pilot flame. Fuel such as natural gas is provided to the annular manifold 16 through the cylinders 16*a* and is dispensed from the annular manifold 16 through a plurality of numerous holes or apertures 32 in the downstream face of manifold 16 (facing toward the diffusion nozzle 20). The annular fuel distribution manifold 16 functions to premix fuel with air traveling downstream under pressure towards the diffusion nozzle 20 parallel to the elongated nozzle body 12 while the air stream surrounds the manifold 16 on all sides. The fuel, which is ejected under pressure from the numerous holes 32, is mixed into the air stream and is propelled downstream to the diffusion pilot flame created at the fuel nozzle 20 where combustion occurs creating an even greater flame formed from the premixed fuel and the diffusion flame. The diffusion nozzle body 12 and its operation are described below. The entire fuel distribution system 10, shown in FIG. 1, is encased in a chamber or housing in operation and would be utilized as a secondary fuel distribution system in a two-stage, two-mode combustor used in a turbine combustion engine.

Figure 2:
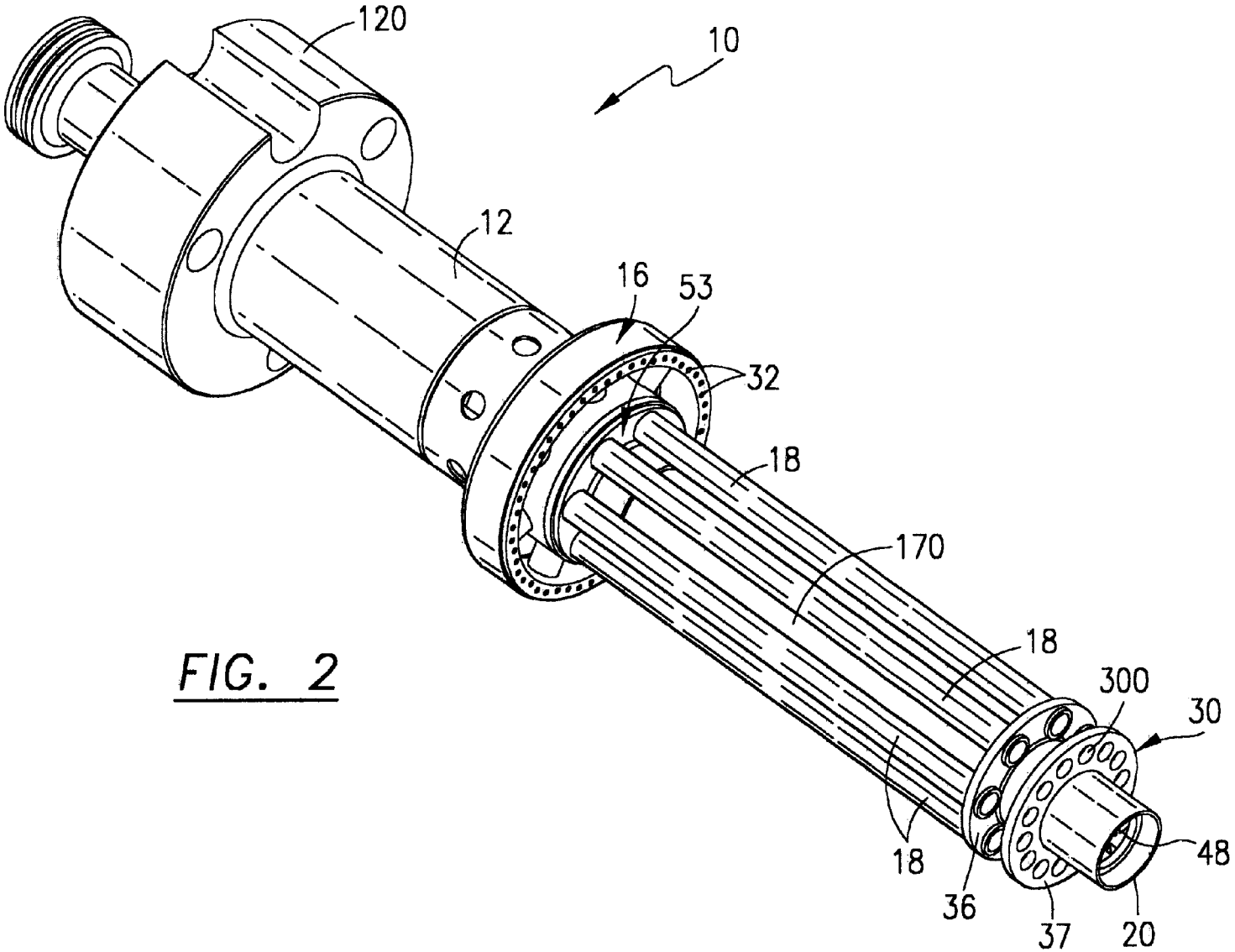
FIG. 2 shows a perspective view of the present invention with a portion of the outer housing removed.

Referring now to FIG. 2, the annular manifold 16, which is essentially hollow and includes the plurality of holes or apertures 32 on the downstream side of the manifold 16, surrounds the body 12 that makes up the diffusion nozzle terminating in the diffusion nozzle 20 at the end of the elongated body. A portion of the diffusion nozzle housing 12 is not shown in FIG. 2 in order to show the fuel transfer tubes 18. The diffusion nozzle functions with a plurality of seven separate fuel transfer tubes 18, which transfer fuel into a spool swirler 30 through openings in spool plate 36. Contained in a separate housing 170 inside the fuel tubes is another elongated tube that includes an air chamber serviced by seven separate air passages 22 in middle spool 53 that supply air to the diffusion nozzle 20 as described below. The transfer fuel tubes 18 provide fuel for burning during the interim transfer operation from combustion in the primary combustion chambers to the secondary combustion chamber. Extra fuel is needed during transfer only and is supplied by tubes 18. Transfer fuel exits through the open end of tubes 18 into the swirl spool 30 where the fuel is dispersed through apertures 300 to sustain the turbine interim operations while switching from the primary combustion chambers to the secondary combustion chamber.

Figure 3:
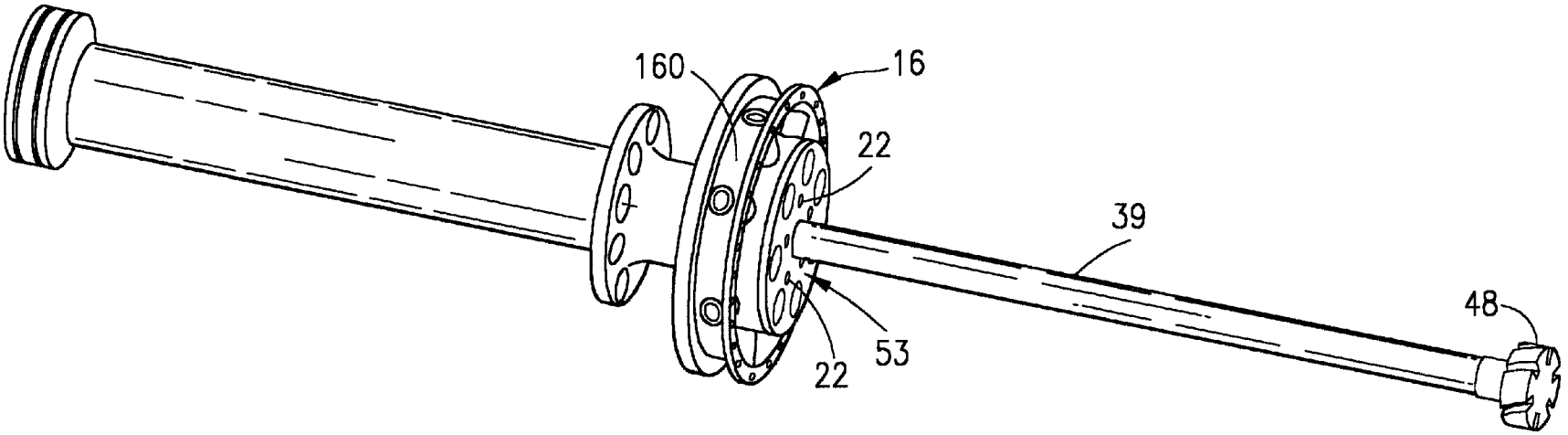
FIG. 3 shows a perspective view of a portion of the present invention.

FIG. 3 shows the diffusion nozzle fuel tube 39 connected to an inner swirler 48 that provides for the diffusion nozzle pilot flame which emanates from the inner swirler 48. The seven transfer fuel tubes have been removed from FIG. 3 for clarity. The middle spool piece 53 includes a plurality of air passages 22 which provide air to swirler 48 (through housing 17, FIG. 2) to the pilot diffusion flame. The air is diffused from inner swirler 48 in conjunction with fuel from the fuel tube 39 for the pilot flame. Note that the annular tube 16 is mounted separately and surrounds the overall elongated housing that terminates in the diffusion nozzle at the inner swirler 48. The perimeter band 16*b* is not shown in FIG. 3 in order to show the body housing 160 of manifold 16.

Figure 4:
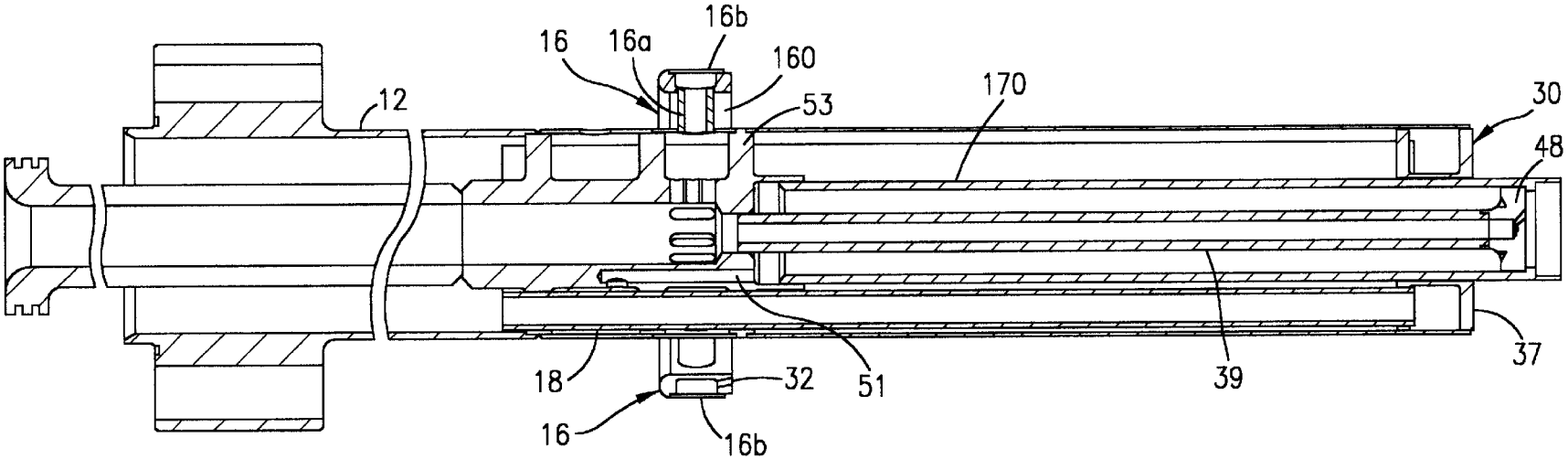
FIG. 4 shows a cross-sectional view of the present invention in side elevation.

FIG. 4 shows the diffusion nozzle fuel supply tube 39 and the inner swirler 48 which includes passages for allowing the fuel to pass from the fuel tube 39 out through the inner swirler 48 and also to allow air to pass through from the surrounding air passage. A transfer fuel tube 18 is also shown. Fuel tube 18 empties into the swirl spool 30 where it passes through the holes in plate 37.

Figure 4A:
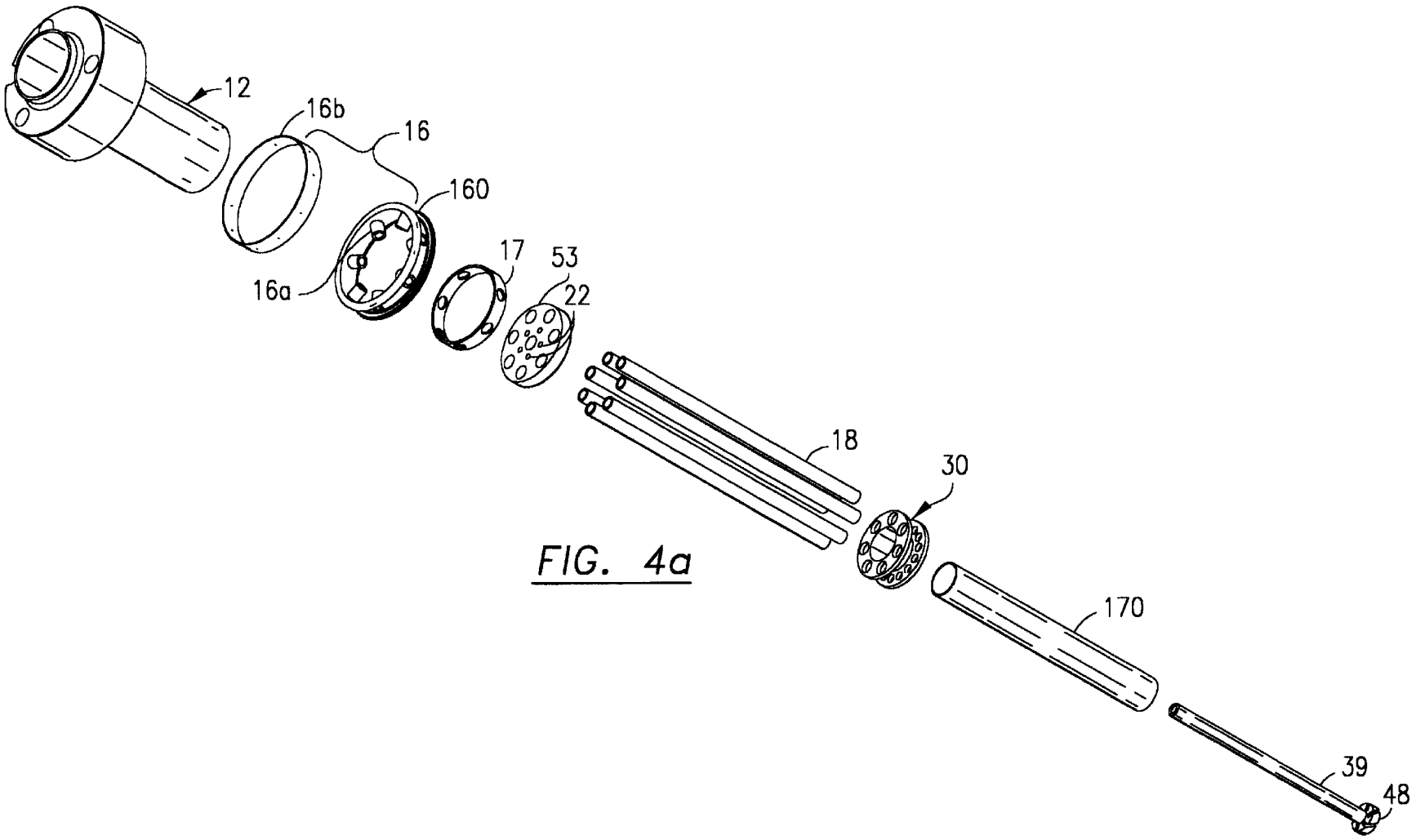
FIG. 4*a* shows an exploded view of a secondary fuel nozzle system in accordance with the present invention.

FIG. 4A shows an exploded view of the overall fuel system which includes the pilot flame fuel tube 39 and swirler 48 which is surrounded by tubular housing 170, which allows air to flow to swirler 48. The swirl spool 30 is attached to the tubular housing 170. The middle spool 53 includes air holes 22 and holes for receiving the transfer tubes 18, which are attached at one end to the middle spool 53 and slide into the swirl spool 30 at the other end. The manifold 16 is supported on housing 12 by sleeve 17.

Figure 5:
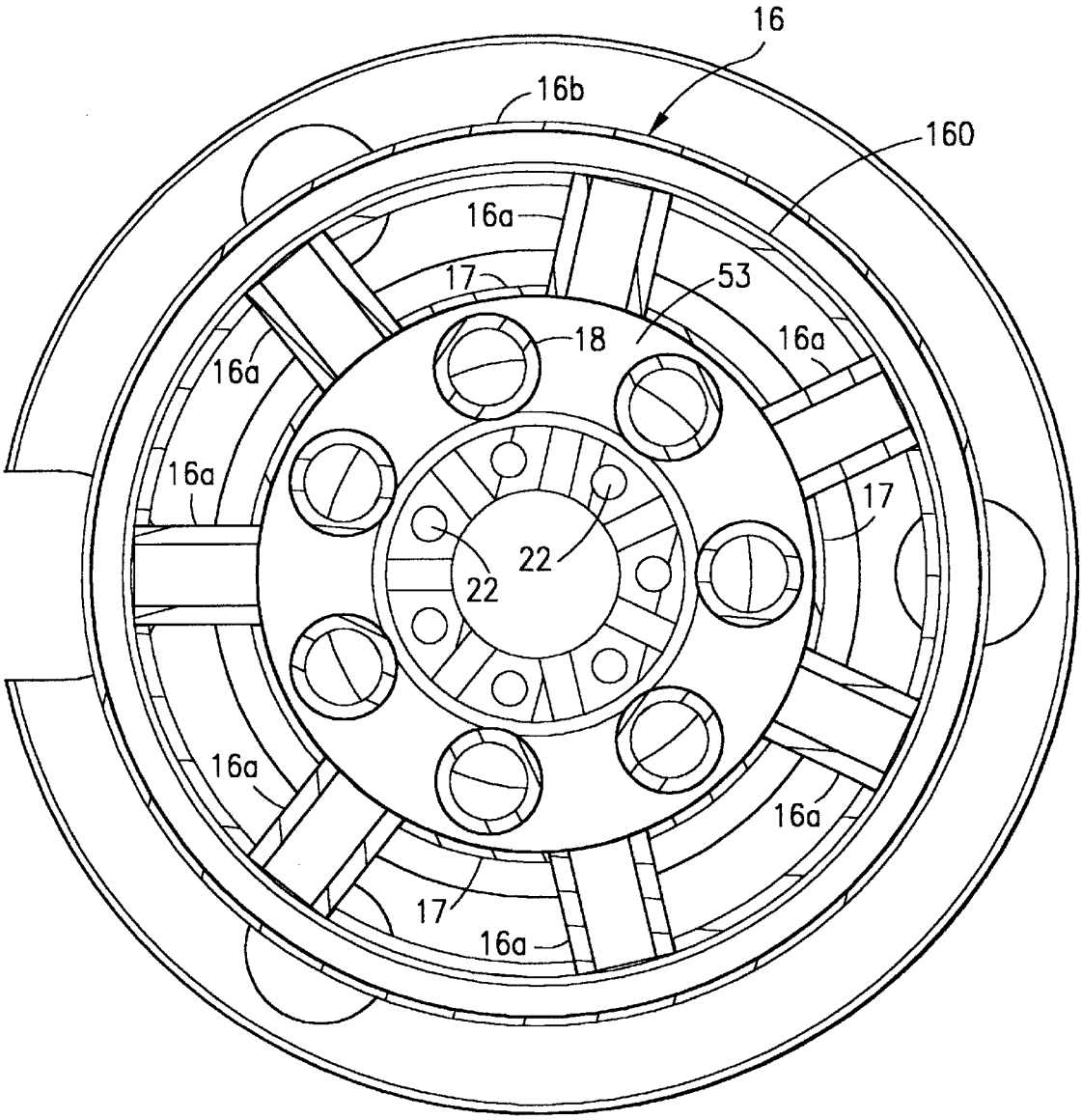
FIG. 5 shows a cross-sectional view through the annular fuel tube as shown in FIG. 4.

FIG. 5 shows a cross-sectional center cut view through the middle spool housing 53 and clearly shows a plurality of air holes 22, the openings for the fuel tubes 18 and the attachment of the manifold 16 which is a hollow annular body with cylindrical tubular support 16*a* connected to sleeve 17.

Figure 6:
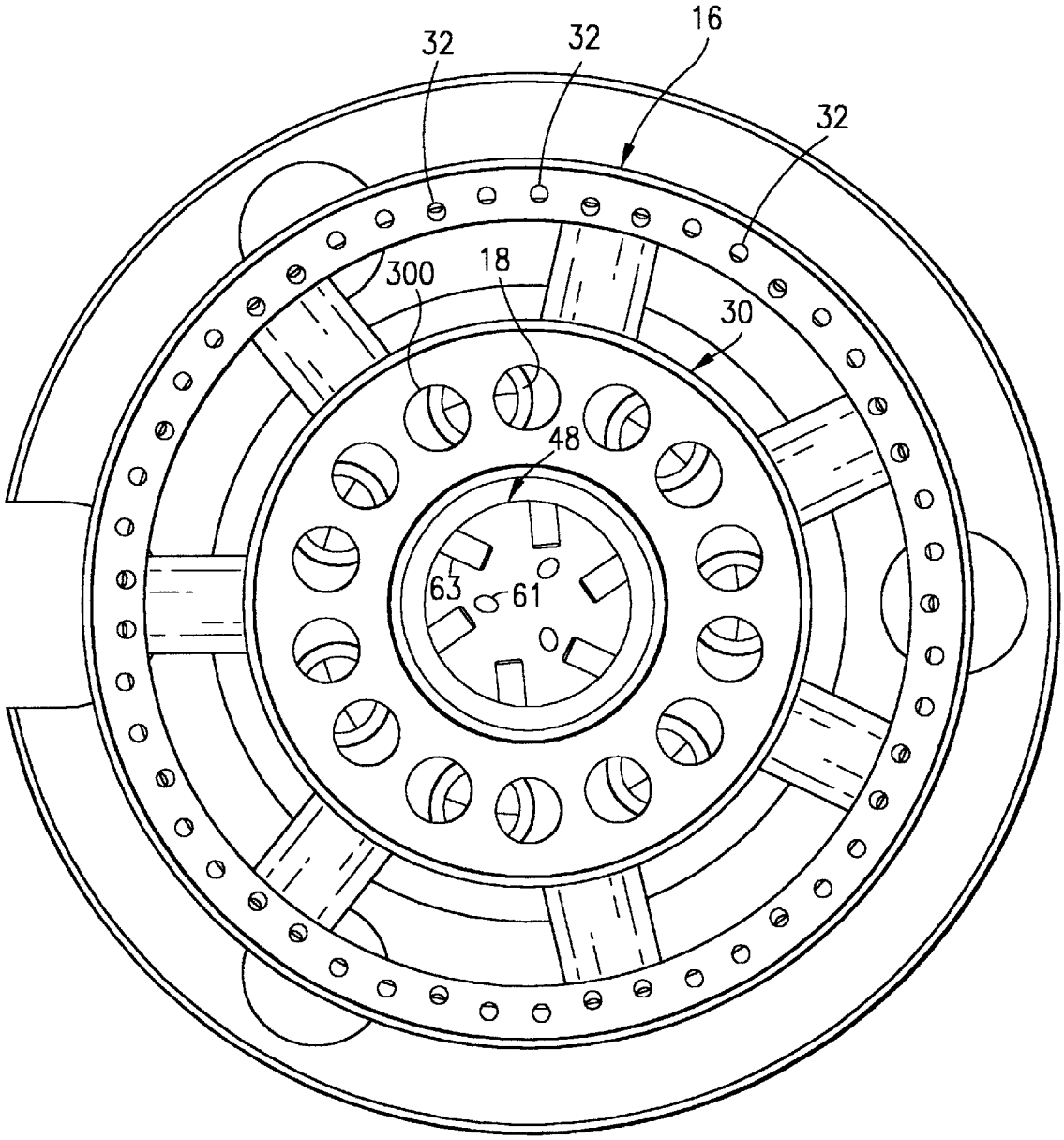
FIG. 6 shows a cross-sectional end view in elevation perpendicular to the longitudinal axis of the diffusion nozzle in accordance with the present invention.

FIG. 6 shows an end elevational view of the fuel orifice 61 and the air slot 63 that are passages in the inner swirler 48. Fuel and air from swirler 48 form the pilot flame for the diffusion nozzle. The fuel transfer tubes 18 empty into the swirl spool 30, which includes a plurality of holes 300 that eject transfer fuel at the tip of the nozzle. Air is run through the transfer tubes 18 at all times except during transitioning when transfer fuel is used.

As shown in FIG. 6, the annular manifold 16 that includes numerous apertures 32, provide for fuel mixing and premix with air on all sides of the manifold 16.

Figure 7:
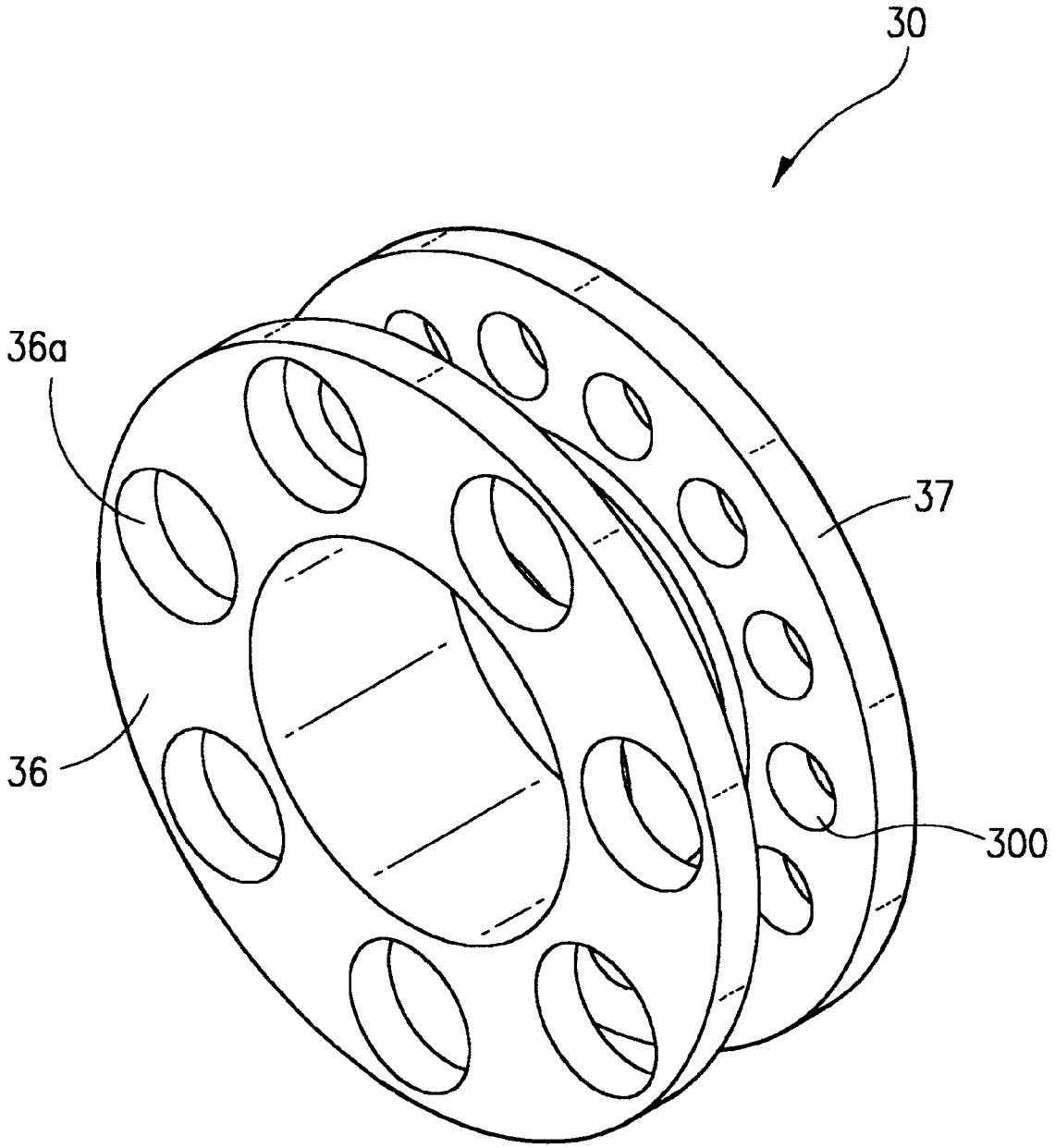
FIG. 7 shows a perspective view of the spool swirler fuel transfer point in accordance with the present invention.

FIG. 7 shows a swirl spool 30 that includes a plate 36 having holes 36*a* where each tube 18 opens up into the swirl spool piece chamber. The spool 30 includes the regulator plate 37 that has more holes 300 than element 36, allowing the transfer fuel to swirl through the end of the diffusion nozzle.

Figure 8A:
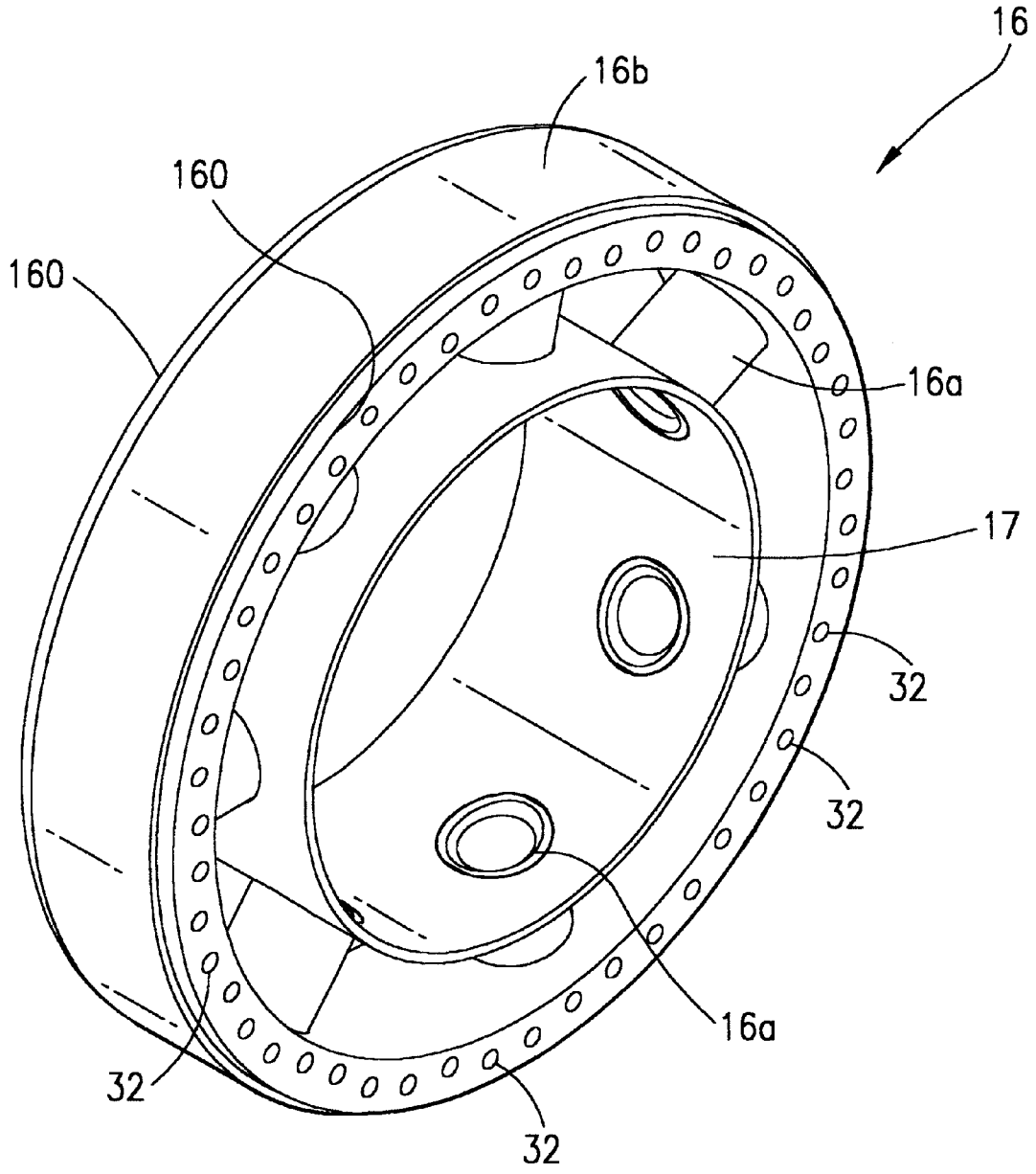
FIG. 8*a* shows a perspective view of the annular fuel distribution manifold.

Referring now to FIG. 8A,the premix fuel manifold is shown generally at 16 in a perspective view that includes a hollow, rigid, annular body that includes a top band or ring 16*b* that is sealably welded to the body inner housing 160 to form a hollow chamber that is ring shaped that receives fuel through support cylinders 16*a* attached to a mounting sleeve 17 that fits onto the diffusion nozzle housing 12. The downstream lip of the body 160 includes a plurality of passages 32, which face along the downstream side face towards the end tip of the diffusion nozzle. Note that the holes or apertures 32 may be staggered in a non-circular pattern and may also have passage axes that are not perpendicular to the end face of the body housing 160. This is to permit greater fuel dispersion in both directions, up and down, relative to the body of the manifold 16 for greater air mixing.

Figure 8C:
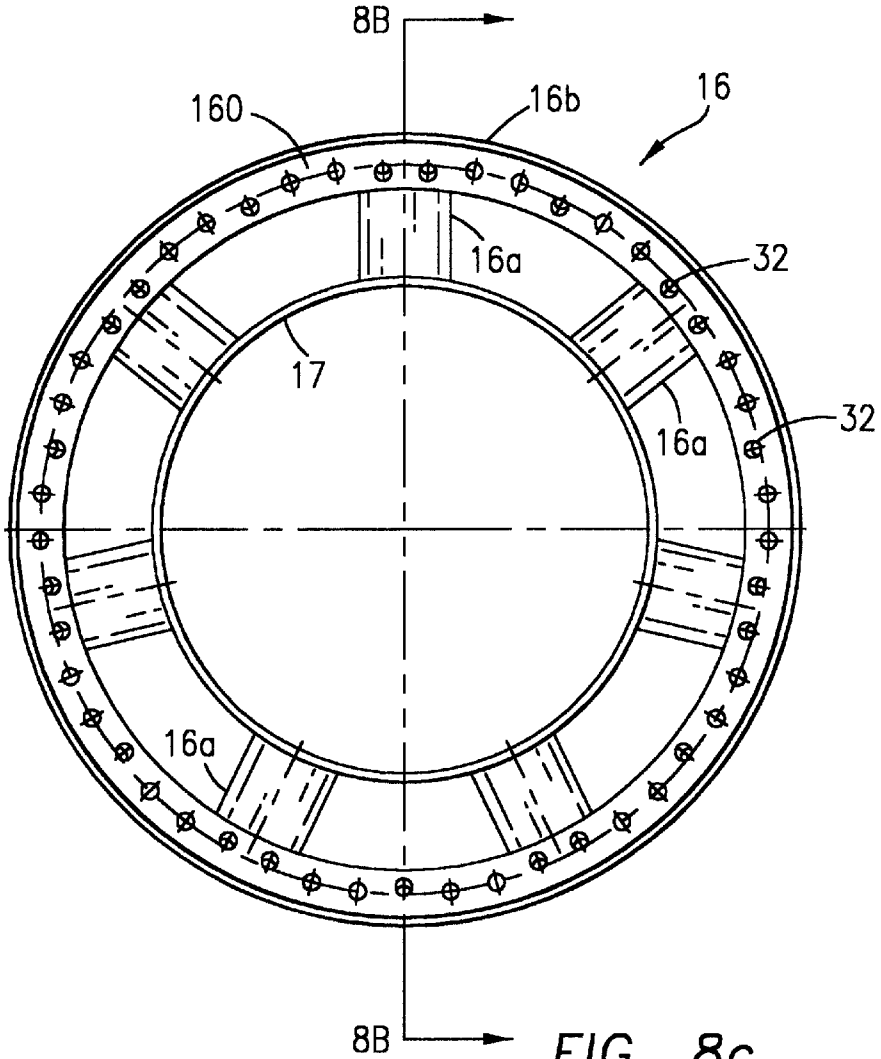
FIG. 8*c* shows an end elevational view looking upstream of the manifold.
Figure 8B:
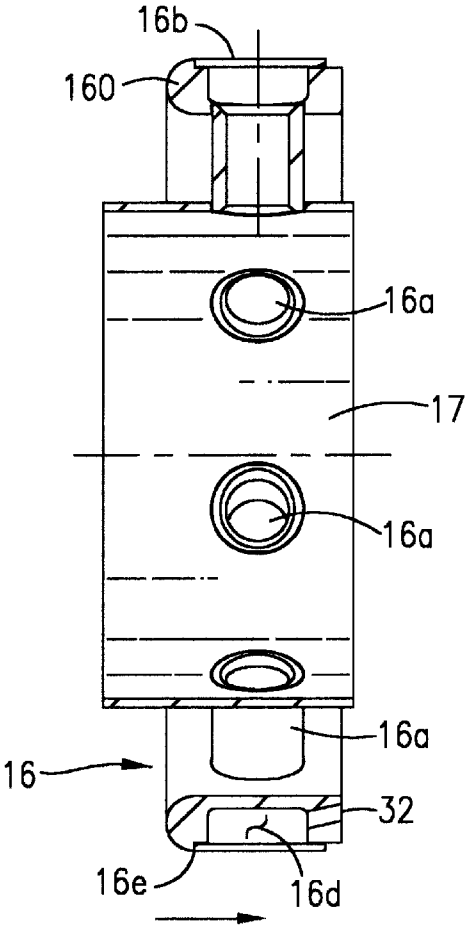
FIG. 8*b* shows a side elevational view in cross section of the annular manifold.

Referring now to FIG. 8B, a cross sectional view of the manifold 16 is shown that shows the shape of the manifold body 160, which is basically annular with a groove throughout the periphery or recess that when attached to band or annular plate 16*b* by welding joints along 16*e* on both sides forms a hollow, somewhat rectangular chamber that is annular completely around the manifold. The upstream body 160 may be semi-circular while the downstream body where apertures 32 pass through the end face may be flat. The body shape 160 from the upstream to the downstream side allows for dynamic flow of the airstream, indicated by the arrow showing the downstream movement for better fuel air mixture. Fuel will be dispensed into passage 16*d* through cylindrical support cylinder 16*a* where it is dispensed or dispersed through passages 32. Note that passage 32 is not perpendicular along its axis to the end phase of body 160 but is in fact angled inwardly. The fuel passages 32 in body 160 may be angled upwardly or downwardly or in a multiple array of patterns as shown in FIG. 8C. Sleeve 17 is used to mount the manifold on the diffusion nozzle housing.

FIG. 8C shows the outer peripheral annular band 16*b* which forms the peripheral top surrounding the manifold 16. Note that the apertures 32, which are shown on the downstream end face of body 160, have a non-circular pattern with a pair of holes facing along their axes inwardly and an adjacent pair of holes which can have their axes facing outwardly or perpendicularly. Note that fuel is dispensed through passages 32, completely around manifold 16 including areas otherwise blocked by support cylinders 16*a* allowing for an even ring distribution of fuel all the way around the manifold 16. FIG. 8C also shows how the air stream can pass on over the top surface 16*b* of the manifold and along the bottom surfaces of the manifold body 160 around the entire manifold body.

Referring back to FIG. 1, the system operation will now be described. For the nozzle system and fuel distribution system to be used in a two-stage turbine combustion engine, the overall system 10 would be used as a secondary fuel nozzle system having a separate premix manifold 16 mounted away from a diffusion nozzle 20 and the diffusion nozzle housing 12. During start-up of the entire turbine combustion engine, the primary fuel nozzles (not shown) would be ignited in the primary fuel chambers (not shown) until the turbine gets up to a particular desired operating RPM, well below full operating RPM. Fuel would then be introduced into the fuel system 10 such that a diffusion pilot light flame will be formed through the (swirler 48) fuel and air mixture emanating from the diffusion nozzle 20 through diffusion nozzle housing 12 in addition to transfer fuel emanating from the regulator 37. Fuel and air will be premixed by fuel emanating from annular manifold 16, which will travel downstream by air flow under pressure for combustion to enhance the overall flame for the secondary combustion chamber. At this time, the primary fuel nozzles would be turned off so that a flame-out in all the primary chambers would be accomplished. Transfer fuel through the transfer tubes 18 will sustain the turbine action. Once the flame-out is accomplished, the primary fuel nozzles are turned on again dispensing a fuel and air mixture into the secondary combustion chamber where it is ignited by the extensive pilot-flame, emanating from the secondary fuel distribution system 10 (secondary and transfer). The fuel to the transfer tubes in swirler 34 would then be diminished or turned off. At full operating range, fuel would be flowing from annular manifold 16 and the diffusion nozzle 20 to ensure (with a large flame) combustion in the secondary chamber.

Although the present invention is shown utilized with a dual-stage, dual-mode turbine combustor, the overall fuel distribution system can be used with other types of combustors to reduce NOx by having a separate, premix annular manifold to enhance fuel mixing and distribution apart from the diffusion nozzle.

The instant invention has been shown and described herein in what is to be considered the most practical preferred embodiment. It is recognized, however, that departures may be made therefrom within the scope of the invention and that the obvious modifications will occur to a person skilled in the art.

What is claimed is:

1. An improved dual-mode, dual-stage gas turbine combustor comprising:

a primary combustion chamber;

one or more primary fuel nozzles positioned to deliver fuel to said primary combustion chamber;

a secondary combustion chamber adjacent to and downstream of said primary combustion chamber;

a venturi passage separating said primary and secondary chambers;

a secondary fuel distribution system situated near said secondary combustion chamber and surrounded by said plurality of said primary fuel nozzles, wherein said secondary fuel distribution system comprises;

an elongated housing having opposing ends;

a diffusion nozzle located proximate one end of said elongated housing;

a plurality of fuel transfer tubes situated within said elongated housing to supply transfer fuel to said diffusion nozzle;

a central fuel distribution conduit connected directly to said diffusion nozzle to deliver fuel to said diffusion nozzle;

a plurality of air flow channels situated within said elongated housing such that said fuel transfer tubes surround said air flow channels and wherein said air flow channels supply air to said diffusion nozzle;

a sleeve affixed to said elongated housing;

a plurality of support members affixed to said sleeve and extending radially outward therefrom; and a premix fuel nozzle comprising an annular tubular manifold circumferentially disposed around said elongated housing, said manifold affixed to said plurality of support members away from said elongated housing and having a plurality of fuel dispersion apertures situated about its periphery and facing in a downstream direction for emitting fuel such that an air stream flowing around the outside of said premix fuel nozzle mixes with said emitted fuel, wherein at least one of said apertures is circumferentially offset from said support members.

2. The gas turbine combustor of claim 1, further comprising a spool situated proximate said diffusion nozzle, said spool having a plurality of apertures, each said aperture to receive one end of one of said fuel transfer tubes.

3. The gas turbine combustor of claim 2, further comprising a spool swirler affixed to said fuel transfer tubes, wherein said spool swirler includes a plurality of holes greater in number than the number of said apertures on said spool connected to said fuel transfer tubes.

4. The gas turbine combustor of claim 1, further comprising a diffusion swirler situated within said diffusion nozzle.

5. The gas turbine combustor of claim 1, wherein seven of said fuel distribution tubes surround seven of said air flow channels.

6. An improved secondary fuel supply system having a premix nozzle and a separate and functionally distinct diffusion nozzle to increase efficiency and decrease overall nitrogen oxides emissions comprising:

an elongated housing having an inlet end and an outlet end;

a diffusion fuel supply nozzle located proximate said outlet end of said elongated housing;

a plurality of fuel transfer tubes situated within said elongated housing, wherein said fuel transfer tubes supply fuel to the outlet end of said elongated housing near said diffusion nozzle;

a central fuel distribution conduit to deliver fuel directly to said diffusion nozzle;

a plurality of air flow channels situated within said elongated housing such that said fuel transfer tubes surround said air flow channels and wherein said air flow channels supply air to said diffusion nozzle;

a sleeve affixed to said elongated housing;

a plurality of support members affixed to said sleeve and extending radially outward therefrom;

a premix fuel supply nozzle comprising an annulartubular manifold circumferentially disposed about and spaced away from said housing, said manifold affixed to said plurality of support members and having a plurality of fuel dispersion apertures situated about its periphery and facing a downstream direction for emitting fuel such that an air stream flowing around the outside of said premix nozzle mixes with said emitted fuel, wherein at least one of said apertures is circumferentially offset from said support members.

7. The secondary fuel supply system of claim 6 wherein at least one of said fuel dispersion apertures is angled relative to the downstream direction.

8. The secondary fuel supply system of claim 6 further comprising a swirl spool located at one end of said fuel transfer tubes near the diffusion nozzle for dispensing fuel and air through said swirl spool.

* * * * *